United States Patent [19]

Mayer et al.

[11] 4,314,236

[45] Feb. 2, 1982

[54] APPARATUS FOR PRODUCING A PLURALITY OF AUDIO SOUND EFFECTS

[75] Inventors: Steven T. Mayer, Auburn; Ronald E. Milner, Grass Vally, both of Calif.

[73] Assignee: Atari, Inc., Sunnyvale, Calif.

[21] Appl. No.: 6,048

[22] Filed: Jan. 24, 1979

Related U.S. Application Data

[63] Continuation of Ser. No. 758,713, Jan. 12, 1977, abandoned.

[51] Int. Cl.[3] ..... G08B 3/00

[52] U.S. Cl. ..... 340/384 E; 340/384 R

[58] Field of Search ..... 340/384 R, 384 E

[56] References Cited

U.S. PATENT DOCUMENTS 3,587,094 6/1971 Scott ..... 340/384 E

*Primary Examiner*—Harold I. Pitts

*Attorney, Agent, or Firm*—Townsend and Townsend

[57] ABSTRACT

Apparatus for producing a plurality of audio sound effects such as shots, explosions, and airplane and car sounds, used in electronic games utilizes a variable clock driving a variable digital noise generator whose audio output amplitude is shaped by either of two types of control units. In one type the density or duty cycle is varied by selectively ANDing together outputs from a polynomial counter. In a second embodiment a digital to analog converter utilizing gated resistive summing provides the amplitude control the gates being driven by a four bit data register which in turn is driven by the game control means.

7 Claims, 12 Drawing Figures

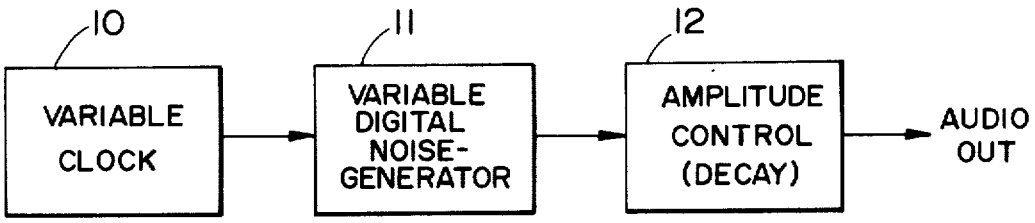
FIG. 1
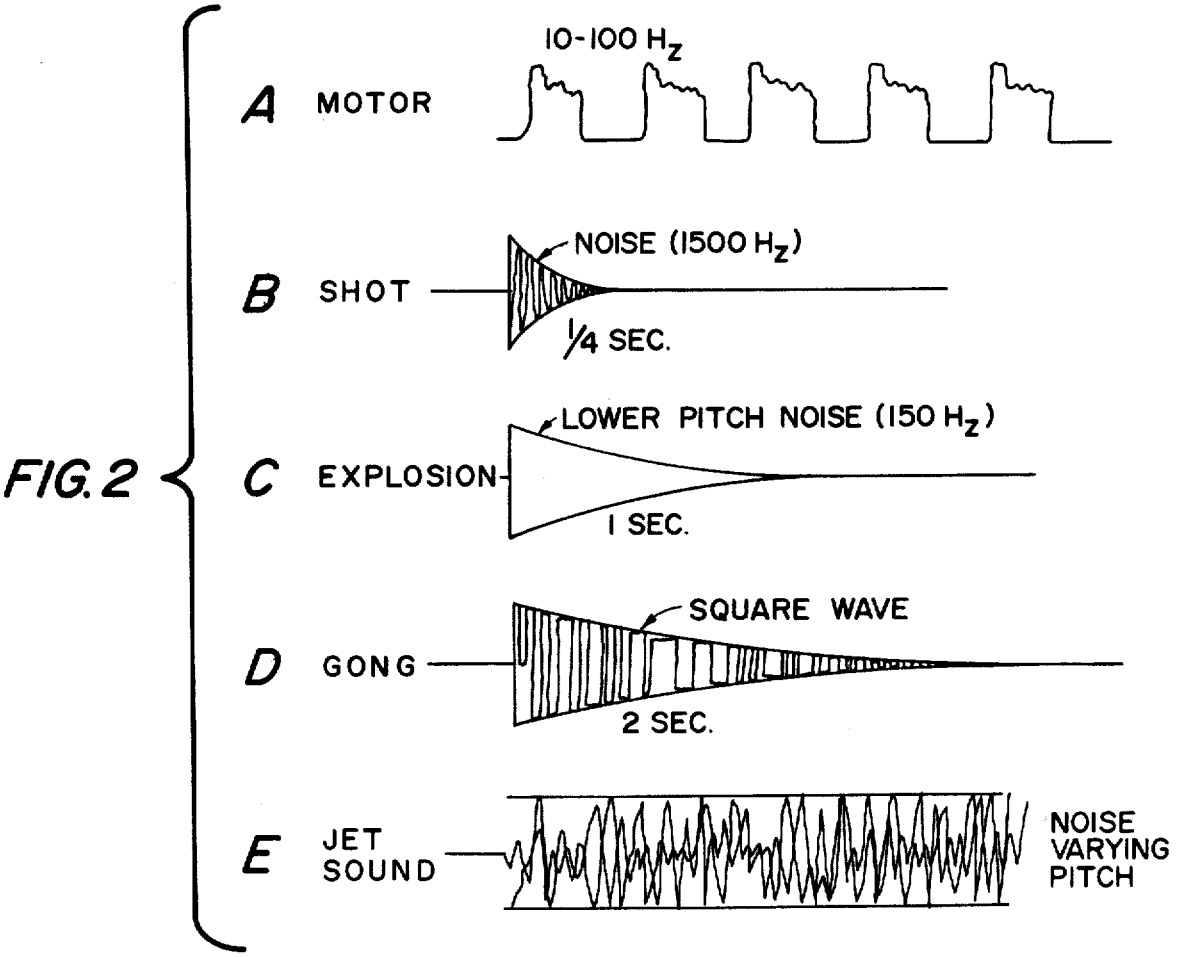

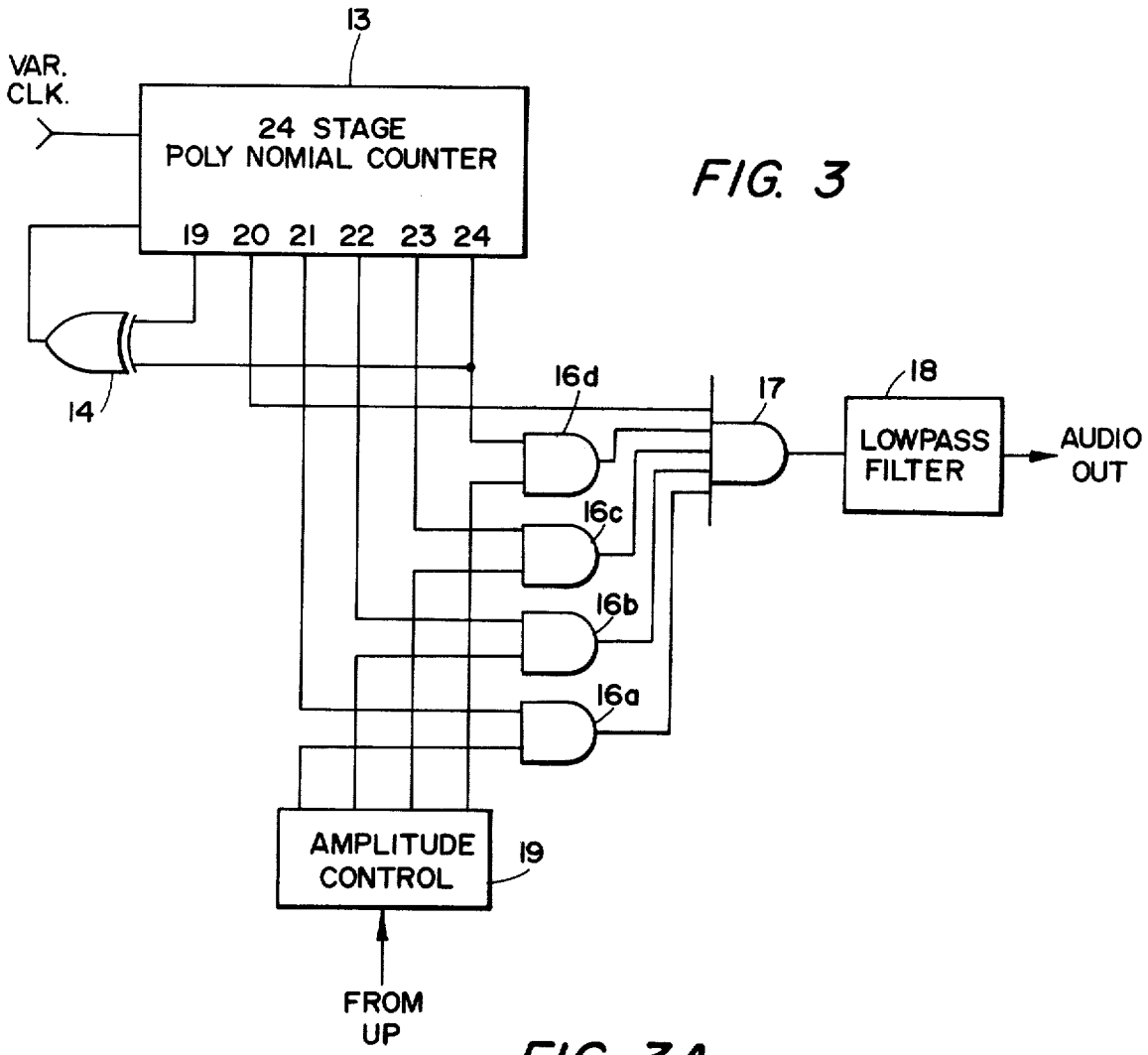
FIG. 3
FIG. 3A
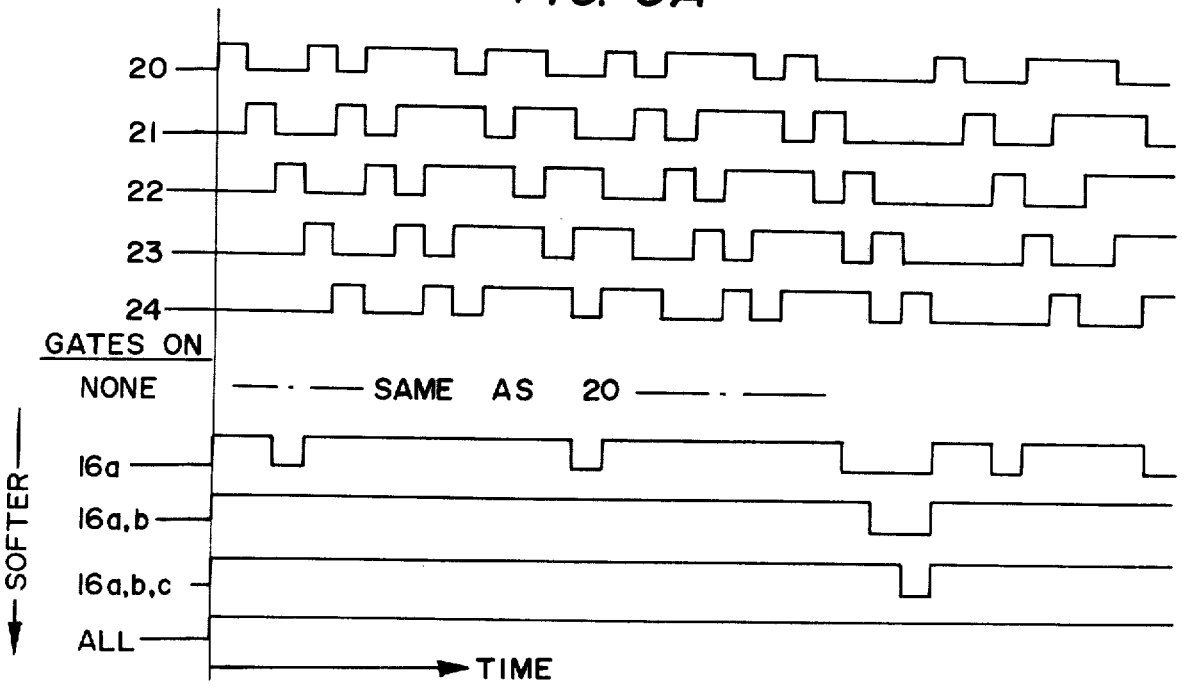

| D4 | D3 | D2 | D1 | DØ | |
|---|---|---|---|---|---|
| 0 | 0 | 0 | 0 | 0 | NO DIV. |
| 0 | 0 | 0 | 0 | 1 | ÷ 2 |
| - | - | - | - | - | ⋮ |
| 1 | 1 | 1 | 1 | 0 | ÷ 31 |
| 1 | 1 | 1 | 1 | 1 | ÷ 32 |

| D3 | D2 | D1 | DØ | |
|---|---|---|---|---|
| 0 | 0 | 0 | 0 | NONE |
| 0 | 0 | 0 | 1 | LOWEST |
| - | - | - | - | |
| 1 | 1 | 1 | 0 | |
| 1 | 1 | 1 | 1 | HIGHEST |

APPARATUS FOR PRODUCING A PLURALITY OF AUDIO SOUND EFFECTS

This is a continuation of application Ser. No. 758,713, filed Jan. 12, 1977 now abandoned.

BACKGROUND OF THE INVENTION

The present invention relates to apparatus for producing a plurality of audio sound effects and more specifically for producing sound effects for electronic games such as shots, explosions, motors, gongs and jet plane and automobile sounds.

Present techniques used in electronic games for producing sound effects include analog noise sources whose output is shaped by a voltage controlled amplifier to provide a proper decay or envelope characteristic. Alternatively, digital polynomial counters are also used as the analog noise source.

One disadvantage of the foregoing is that the analog portions of the circuit are not suitable for large scale integration. This is an especially critical cost consideration when home or consumer type video games are to be connected to a home television receiver. Secondly, the present sound effect techniques are usually special purpose directed to one or two sound effects at the most. Individual sound effect generators are used for each effect, resulting in a large number of separate circuits for each game.

OBJECTS AND SUMMARY OF THE INVENTION

It is, therefore, a general object of the present invention to provide improved apparatus for producing audio sound effects.

It is another object of the invention to provide apparatus as above which produces a plurality of audio sound effects the apparatus being suitable for large scale integration.

In accordance with the above objects there is provided apparatus for producing a plurality of sound effects which has a variable digital noise generator having a digital noise output. A variable clock drives the noise generator. Means provide a plurality of predetermined envelope characteristics for the generator output and provide an audio output.

BRIEF DESCRIPTION OF THE DRAWINGS

FIG. 1 is a block diagram embodying the present invention;

FIGS. 2A through 2E are various waveforms showing some of the sound effects produced by the present invention;

FIG. 3 is a block diagram of one embodiment of the present invention;

FIG. 3A is an associated timing diagram useful in understanding FIG. 3.

DETAILED DESCRIPTION OF THE PREFERRED EMBODIMENTS

Figure 4A:
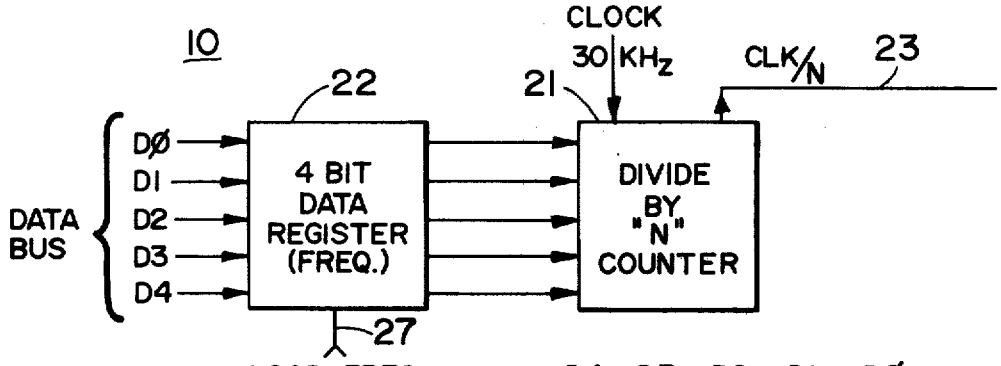
FIGS. 4A–D are circuit schematics of another embodiment of the invention.

Referring now to FIG. 1, a variable clock 10 drives a variable digital noise generator 11 which may, for example, be a polynomial counter. The noise generator may be varied to provide either white noise, regular waveforms for tones, or irregular waveforms for motor sounds. The variable clock contains the pitch of generated tones. For example, if white noise is selected, the variable clock can change the pitch from a pistal shot to an explosion. The output of noise generator 11 has its decay characteristic (that is, its envelope) controlled by amplitude control unit 12 which provides an audio output.

FIGS. 2A through E show different types of sound effects and specifically FIGS. 2B, 2C and 2D illustrate the different sound effects obtained by varying the decay of the envelope and the waveform generated. For example, a shot has approximately a ¼ second decay time, an explosion to two seconds and a gong one to two seconds. The type of noise generated by noise generator 11 also is an important criterion where the shot and explosion utilize a white type of noise and the gong a square wave. In addition, the variable clock 10 provides for the shot, a noise frequency of approximately 1,500 Hz and for the explosion a lower pitched noise frequency of 150 Hz. FIG. 2A shows the waveform of a motor such as an idling motor which may range in frequency from 10 to 100 Hz and FIG. 2E a jet plane sound where the envelope is constant and the pitch varies. This is produced by a variation of clock 10. For a single sound effect it may be necessary to vary the clock frequency to ten different settings. This would be to simulate a steady acceleration. In simulating a race car, 16 different frequencies might be used.

In any case, the illustrations of FIG. 2 are merely representative of the many sound effects created by the present invention and, of course, the frequencies and timings given are only typical examples.

Finally, although the generator 11 is termed a "noise" generator, it is still capable of producing relatively sinusoidal or tonal sounds.

One embodiment of the invention is shown in FIG. 3 which utilizes a 24 stage polynomial counter 13 as a noise generator and is driven by a variable clock source. The counter has a feedback loop including the gate 14. The last five stages 20 through 24 are illustrated which are connected to AND gates 16*a* through *d*. The outputs of these AND gates are connected to an OR gate 17 and through a low pass filter 18 provide an audio output. Amplitude or decay of the audio output is controlled in essence by reducing the density or duty cycle of the gated output. As indicated by the associated timing diagram in FIG. 3A the output 21 of the polynomial counter 13 is delayed a longer time than output 20. And if these two outputs are combined by turning gate 16*a* on, a lower duty cycle or lower density will result producing in effect a lesser perceived amplitude and a softer volume. AND gates 16*a–d* are controlled by an amplitude control unit 19 which in turn is controlled by a preprogrammed microprocessor.

Thus in summary, the circuit of FIG. 3 provides for selective summing of a plurality of stages of a polynomial counter to effectively vary the perceived amplitude of the audio output wave and thus control its decay or envelope characteristic and the resulting sound effect. Amplitude control unit 19 includes digital control inputs which are thus easily controllable by an associated microprocessor.

Another embodiment of the invention is shown in FIGS. 4A–D where in FIG. 4A the variable clock 10 is shown in detail. This includes a divide by N counter 21 driven by a 30 kHz clock input whose division is controlled by a four bit data register 22. The data register has digital inputs D0 through D4 which determine the final frequency output on line 23 of variable clock 10. A decode table is listed in FIG. 4A and includes the possibility of division by two up to division by 32. The indicated data bus to the data register 22 is from, referring to FIG. 4B, the microprocessor 24 which has a data bus 26 and an address decode control line 27. This control line provides for a time share type of loading and control of register 22 and two other data registers illustrated in FIGS. 4B and 4C.

Figure 4C:
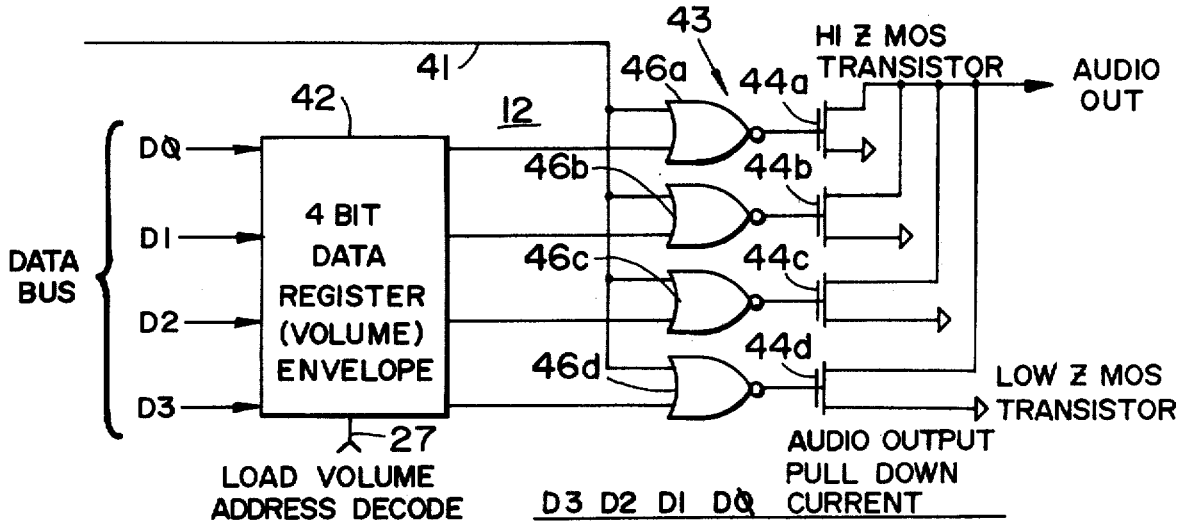
Figure 4D:
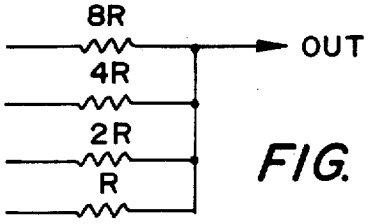
Figure 4B:
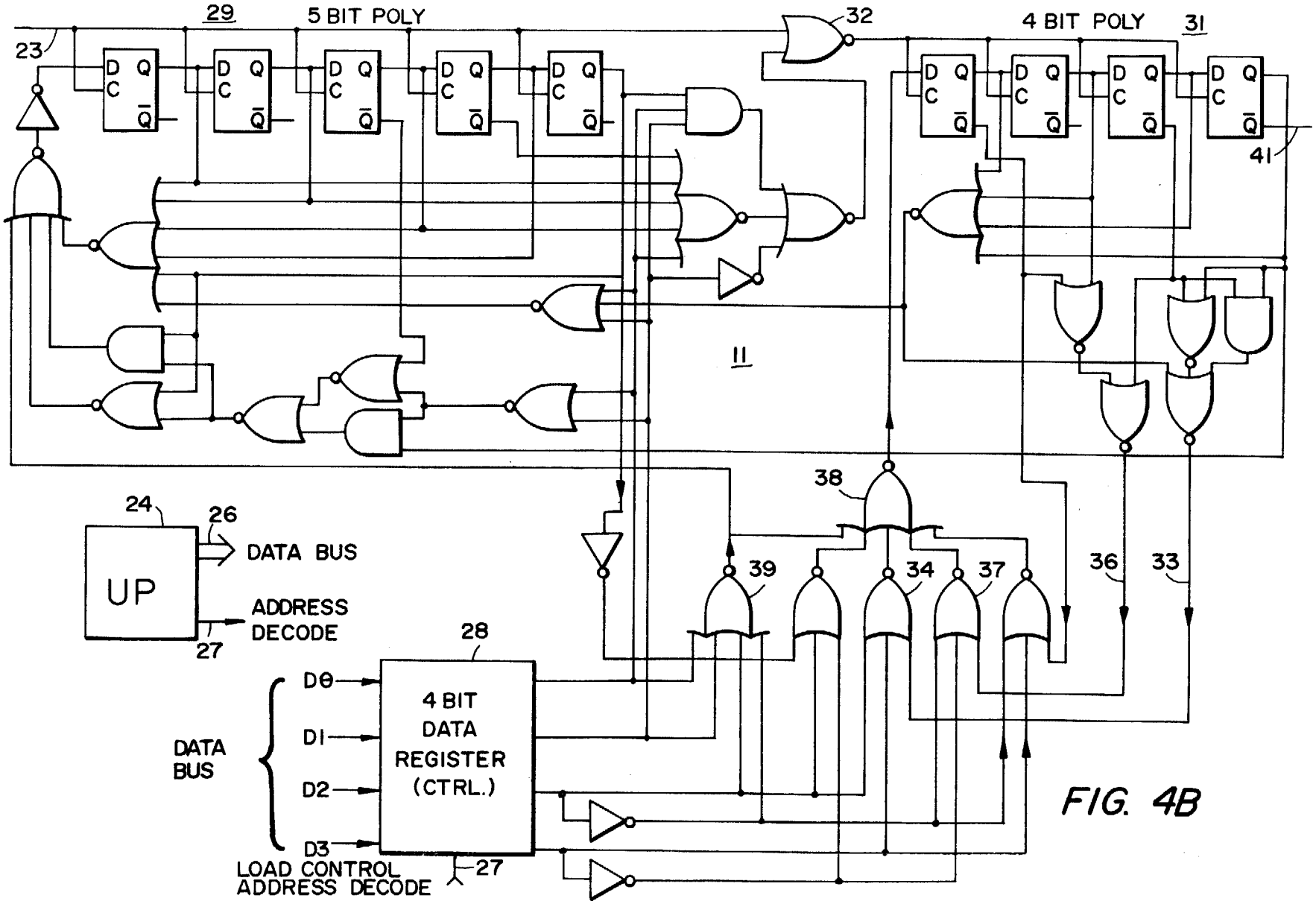

Still referring to FIG. 4B, the four bit data register 28 receives bits D0 through D3 from the data bus 26 to provide a variable digital noise generator. The generator includes a five bit polynomial counter 29 and a four bit polynomial counter 31 which are linked together by the illustrated gating. Counter 29 may function as a prescaler. Five bit counter 29 has five D-type flip-flops and counter 31 four D-type flip-flops. Variable clock output on line 23 is directly coupled to the clock inputs of the five clock (C) inputs of the five bit polynomial counter 29 and inverted through NOR gate 32 and then coupled to the clock inputs of four bit counter 31.

Thus, the noise generator of the embodiment of FIG. 4B can provide a nine stage polynomial counter, or other configurations depending on the programmed feedback paths, which is believed to provide the maximum flexibility for producing different types of sound effects at a minimum cost. An eight stage counter will not produce as adequate a range of noise type sound effects nor would the quality of each sound effect be as effective. The longer the polynomial counter is, of course, the greater the number of shift sequences before any repetition occurs and therefore theoretically a pure type of white noise may be produced. On the other hand, the gating as illustrated also provides for division of the effective square wave on line 23 to provide a relatively pure pitched or tonal audio sound.

The associated Table I indicates the different variations of the noise generator 4B with full hexadecimal range 0 through 9 and A through F by the variation of the four binary control inputs D0 through D3. In the hexcode zero all stages are set to 1 which is used for testing or providing sound effects by the amplitude control stage of FIG. 4C. The remaining combinations provide a very pure division of the clock frequency, a polynomial noise counter effect or a combination of the two. For example, hexcode eight combines all nine stages together to provide a "white" noise.

In operation with hexcodes 1 through 3 the four bit polynomial noise counter 31 is in operation with a feedback on line 33. This line is connected to a gate 34 which has an output when the D2 and D3 inputs are zero. Note this is the condition of hexcodes 1, 2 and 3.

Next, if D2 and D3 are both one as shown in hexcodes C through F, four bit polynomial counter 31 acts as a three bit twisted ring having a one output on feedback line 36, and drives the gate 37 which has as its other two inputs the inverted D2 and D3 which are both zeroes to make the gate effective. Gate 38 provides typical OR action. Gate 39 corresponds to the hexcode zero where all binary inputs are zero.

Referring to FIG. 2 and the representative sounds, the motor might be provided by the hexcode 3 since the five bit polynomial counter prescaler driving a four bit polynomial counter produces a plausible motor sound. A shot or explosion utilizes white noise; thus it is provided by hexcode eight. A gong may use a square wave and thus no polynomial noise generation counting action but rather just division, for example, is provided by hexcodes four and five. Lastly, a jet plane would again be provided by the white noise of hexcode eight.

The output 41 of the noise generator of FIG. 4B is shaped by the amplitude control unit 12 illustrated in FIG. 4C. Here a four bit data register 42 controlled by bits D0 through D3 from the data bus 26 provide for digital control at any instant in time of the amplitude of the audio output; in other words, the decay envelope. Data register 42 drives what is an effective digital to analog converter 43 which utilizes the gated resistive summing of the type shown in FIG. 4D where the weighted resistors R, 2R, 4R and 8R are selectively used to control amplitude providing an analog output in response to a digital input. However, the weighted resistors may be actually MOS type transistors 44*a–d* driven by the representative NOR gates 46*a–d* (which are actually AND type functioning gates). MOS transistors 44 provide the different resistances by varying the drain or source area with the drain area, for example, of transistor 44*d* being 16 times as large as 44*a*.

The decoding scheme is also shown in FIG. 4C with a 0001 binary input producing the lowest audio output pull down current meaning the smallest amplitude and 1111 the highest amplitude. The microprocessor (FIG. 4B) provides on an on-line basis the instantaneous proper control code to produce the envelopes as shown in FIGS. 2A through E. A typical microprocessor can easily provide a new control instruction every 1/60 second. Thus, several control instructions can be provided, for example, in ¼ second to provide a very effective shot envelope of FIG. 2B. The amplitude control unit of FIG. 4C is intended to be implemented in large scale integration especially by the technique of the different areas for the resistive summing of the digital to analog converter 43. Also noise generator 11 in both of its forms is also easily integrated since it produces a digital output.

As illustrated in FIG. 4C, the amplitude control unit is connected to single output line 41 of the noise generator. Each gate 46*a–d* could be connected to different points of the polynomial counter to achieve a somewhat different sound effect.

Thus, in summary the present invention provides an improved apparatus for producing a plurality of different audio sound effects which are variable by the digital coding from a microprocessor. All the apparatus is easily implemented in large scale integration.

TABLE I

| HEXCODE | D3 | D2 | D1 | D0 | TYPE OF NOISE OR DIVISION |
|---|---|---|---|---|---|
| 0 | 0 | 0 | 0 | 0 | SET TO 1 |
| 1 | 0 | 0 | 0 | 1 | 4 BIT POLY |
| 2 | 0 | 0 | 1 | 0 | ÷15→ 4 BIT POLY |
| 3 | 0 | 0 | 1 | 1 | 5 BIT POLY 4 BIT POLY (MOTOR SOUND) |
| 4 | 0 | 1 | 0 | 0 | ÷2 (TONES) |
| 5 | 0 | 1 | 0 | 1 | ÷2 |
| 6 | 0 | 1 | 1 | 0 | ÷31 |
| 7 | 0 | 1 | 1 | 1 | 5 BIT POLY → ÷2 |
| 8 | 1 | 0 | 0 | 0 | 9 BIT POLY (WHITE NOISE) |
| 9 | 1 | 0 | 0 | 1 | 5 BIT POLY |
| A | 1 | 0 | 1 | 0 | ÷31 |
| B | 1 | 0 | 1 | 1 | SET LAST 4 BITS TO 1 |
| C | 1 | 1 | 0 | 0 | ÷6 |
| D | 1 | 1 | 0 | 1 | ÷6 |
| E | 1 | 1 | 1 | 0 | ÷93 |
| F | 1 | 1 | 1 | 1 | 5 BIT POLY ÷6 |

What is claimed is:

1. An apparatus for selectively producing any one of a plurality of predetermined sound effects each specified by an associated digital command character, said apparatus comprising:

variable clock means for generating a binary clock signal having a frequency specified by an associated digital command character, said clock means including an input terminal adapted to be coupled to a source of timing signals, an output terminal for manifesting said binary clock signal, a data input terminal adapted to be coupled to said associated digital command character, and means coupled to said input terminal, said output terminal and said data input terminal for transforming said timing signals to said binary clock signals; and sound generator means for generating sound effect signals corresponding to said associated digital command character, said sound generator means including an input terminal coupled to said output terminal of said variable clock means, an output terminal for manifesting the electrical analog signals corresponding to said desired sound effect, counter means coupled to said input terminal and said output terminal for generating a binary signal train in response to the receipt of said binary clock signal, said binary signal train having a frequency content specified by said digital command character, and means coupled to said counter means for converting said binary signal train to said electrical analog signals corresponding to said desired sound effect, said converting means including means for providing a predetermined amplitude attenuation characteristic corresponding to said desired sound effect specified by said digital command character.

2. The combination of claim 1 wherein said transforming means includes a divide-by-N counter, where N is an integer, and a digital character register having input means for receiving said digital command character and output means coupled to said divide-by-N counter for controlling the value of N.

3. The combination of claim 1 wherein said counter means includes a multi-stage polynomial counter and first gating means coupled between predetermined states of said polynomial counter for controlling said frequency content in accordance with said digital command character.

4. The combination of claim 3 wherein said first gating means includes a first plurality of individual gating circuits each having an input coupled to the output of a predetermined one of said polynomial counter stages, and wherein said means for providing a predetermined amplitude attenuation characteristic includes means for selectively summing the output signals from said plurality of individual gating circuits to vary the amplitude of each frequency component in accordance with said digital command character.

5. The combination of claim 4 wherein said converting means includes low pass filter means coupled to the output of said summing means.

6. The combination of claim 3 wherein said means for providing a predetermined amplitude attenuation characteristic includes second gating means comprising a second plurality of individual gating circuits each having an input coupled to the output of a predetermined one of said polynomial counter stages, resistive summing means including a plurality of resistive elements each having a first terminal coupled to the output of a different one of said second plurality of individual gating circuits and a second terminal coupled to said sound generator means output terminal, and a digital character register having input means for receiving said digital command character and output means coupled to said second gating means for controlling the state of each of said individual gates so that the binary signal from said predetermined one of said polynomial counter stages is selectively applied through said second plurality of individual gating circuits and said plurality of resistive elements to said sound generator means output terminal.

7. The combination of claim 6 wherein said resistive summing means comprises a plurality of integrated field effect transistors each having a gate element coupled to the output of a different one of said second plurality of individual gating circuits, and wherein each of said resistive elements comprises the drain region of a different one of said plurality of integrated field effect transistors, said drain regions having areas proportional to the desired resistive summing.

* * * * *